United States Patent [19]

Uetomi et al.

[11] Patent Number: 4,651,057

[45] Date of Patent: Mar. 17, 1987

[54] STANDING-WAVE ACCELERATOR

[75] Inventors: Isamu Uetomi; Masakazu Kimura, both of Osaka; Kazumasa Ogura, Sanda, all of Japan

[73] Assignee: Mitsubishi Denki Kabushiki Kaisha, Tokyo, Japan

[21] Appl. No.: 699,441

[22] Filed: Feb. 7, 1985

[30] Foreign Application Priority Data

Feb. 9, 1984 [JP] Japan ..... 59-23261

[51] Int. Cl.[4] ..... H01J 25/10

[52] U.S. Cl. ..... 315/5.41; 315/5.42; 333/231; 333/232

[58] Field of Search ..... 315/5.41, 5.42; 333/223, 231, 232

[56] References Cited

U.S. PATENT DOCUMENTS 3,546,524 12/1970 Stark ..... 315/5.41
3,906,300 9/1975 Tran ..... 315/5.41
4,118,652 10/1978 Vaguine ..... 315/5.41
4,146,817 3/1979 McEuen et al. ..... 315/5.41
4,155,027 5/1979 Schriber et al. ..... 315/5.41
4,286,192 8/1981 Tanabe et al. ..... 315/5.41
4,382,208 5/1983 Meddaugh et al. ..... 315/5.41
4,400,650 8/1983 Giebeler, Jr. ..... 315/5.41

*Primary Examiner*—Saxfield Chatmon
*Attorney, Agent, or Firm*—Birch, Stewart, Kolasch & Birch

[57] ABSTRACT

A standing-wave accelerator including a plurality of accelerating cavities arranged along the axis direction of the accelerator; a plurality of coupling cavities provided between the two-adjacent accelerating cavities; at least one of the coupling cavities is provided with a detuning device for detuning the coupling cavity; and the detuning device is provided to be inserted from a first wall of the coupling cavity to extend until it comes into contact with a second wall thereof, spacedly passed between a pair of inwardly projecting posts.

6 Claims, 4 Drawing Figures

STANDING-WAVE ACCELERATOR

FIELD OF THE INVENTION

The present invention relates to a standing-wave accelerator, and more particularly, to an energy variable side-coupled standing-wave accelerator. BACKGROUND OF THE INVENTION To explain the background of the invention, reference will be made to FIG. 1, which shows a sectional view of a typical example of a side-coupled standing-wave accelerator.

The accelerator includes a beam entrance 1 and a beam exit 2, which are produced in respective end flanges 3 and 4. The accelerator includes a waveguide 5 through which microwave energy is supplied from a source. The reference numeral 6 designates a beam path (a drift space) axially produced. The reference character G designates a gap in which a microwave electric field is produced. In addition, there are provided accelerating cavities An (n=1 to 30); cylindrical coupling cavities Sn (n=1 to 29); connecting openings 7 through which one accelerating cavity and one coupling cavity are mutually communicated. Each of the cylindrical coupling cavities Sn has mutually opposing circular side walls 8 and 9, wherein the side wall 9 will be hereinbelow referred to as the opposing side wall, and a pair of inwardly projecting posts 10 are provided spaced from each other so as to produce a reentrant type cavity gap therebetween.

The conventional accelerator is the one in which the coupling cavity S15*a* is deleted in the accelerator of FIG. 1.

In operation, microwave energy is introduced into the accelerating cavities An through the waveguide 5, and it is transmitted to the coupling cavities Sn, thereby producing a standing-wave electric field in the gap G. The standing-wave electric field in one accelerating cavity An is phasically differentiated by $\pi$ from that in the next accelerating cavity An+1. As a result, it is possible to arrange the cavities such that the electron beam passing along the axis of the accelerator is subjected to an accelerating microwave electric field in each of the accelerating cavities An by predetermining the length of the beam path 6 (the size of the drift space), in more detail, the length L1 of the aperture of each accelerating cavity and the length L2 of the intermediate wall between two adjacent accelerating cavities, as desired. Accordingly, when the electron beam reaches the exit of the accelerator, it will have become a high energy beam.

The electron beam introduced to the accelerator through the entrance 1 usually has an energy level of about 10 to 20 KeV, and its velocity is also low. Accordingly, at the neighborhood of the entrance 1, the beam path 6 is designed to be short so as to satisfy the requirement for equalizing the velocity of phasic variations of the microwave electric field to the velocity of the electron beam. On the other hand, as the cavity number n increases, the beam path 6 is designed to be relatively long because the velocity of the electron beam becomes faster. Beyond the initial several (about 5) cavities, the lengths L1 and L2 can be designed to have constant lengths because the energy of the beam becomes high and its velocity becomes approximately equal to the velocity of light.

The initial portion of cavities along which the length of the beam path 6 is varied is collectively called the buncher section, and the remaining portion of cavities is called the regular section. The energy V obtained by the accelerator is represented by the following equation, provided that the beam current is low:

$$V = 2A\sqrt{\beta \cdot ZT^2 LPo}$$

$$A = \frac{\alpha\tau - 1 + e^{-\alpha\tau} - e^{-1}}{(\alpha\tau - 1)(1 + \beta)}$$

$$\alpha\tau = \frac{\pi f(1 + \beta)}{Qo}\tau$$

where $\beta$: the coupling coefficient between the accelerator and the waveguide;

$ZT^2$: the average shunt impedance;

L: the length of the accelerator;

Po: the electric power of the introduced microwave;

$\tau$: the pulse width of the microwave;

Qo: the Q value (quality factor) of the accelerator;

f: the frequency of the microwave

For example, suppose that the following values are given:

n=30, L=1.54 m, Po=5 MW, f=2856 MHZ, $\beta$=1.05, $\tau=6\times10^6$, Qo=14,000, $ZT^2$=78 MΩ/m The following results are obtained:

$\alpha\tau$=7.883 A=0.462 V=23.2 MeV

Hereupon, the intensity of the average electric field of the accelerator is calculated as follows:

23.2/1.54=15 MeV/m

This proves that such a high energy level such as 23.2 MeV can be obtained.

Where the energy obtained should be varied as in a medical linear accelerator, the common practice is to vary the electric power of the introduced microwave Po. For example, when Po is 1.0 MW, V will be 10.4 MeV. In this case the intensity of the average electric field will be as low as 10.4/1.54=6.7 MeV/m.

The intensity of the electric field in the accelerator which is decided by the input power of the introduced microwave and the length of the accelerator has an influence not only on the energy itself but also on the proportion of an accelerated beam to the total incident beam current, and on the energy spectrum of the accelerated beam which represents the performance of bunching. In this example, if the system is previously designed to achieve the optimum conditions of the above-mentioned two parameters when the energy V is 23.2 MeV, the beam current obtained from the beam having the energy of 10.4 MeV decreases because the intensity of electric field decreases from 15 MeV/m to 6.7 MeV/m, and the beam will have a worsened energy spectrum. This phenomenon greatly depends on variations in the electric field in the buncher section.

As evident from the foregoing description, the conventional standing-wave accelerator is disadvantageous in that the beam current obtained tends to be low and that the energy obtained has a worsened spectrum when the energy is varied to a low value.

Another prior art is disclosed in U.S. Pat. No. 4,286,192 which is characterized in that the phase of the electric field in a selected side coupling cavity is shifted by $\pi$ from that of usual one to become 0 or $2\pi$ the side coupling cavity being disposed between groups of accelerating cavities. Thus the coupling cavity functions as a decelerating cavity thereby to adjust the acceleration energy.

OBJECTS AND SUMMARY OF THE INVENTION

The present invention is directed to solving the problems pointed out with respect to the conventional standing-wave accelerator, and has for its object to provide an improved energy variable standing-wave accelerator in which the coupling cavities can be detuned to prevent the microwave power from transmitting to subsequent accelerating cavities. Thus a constant intensity of the accelerating electric field is obtained in the buncher section through all the operational modes, thereby allowing attainment of a low energy beam without unfavourable influences.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
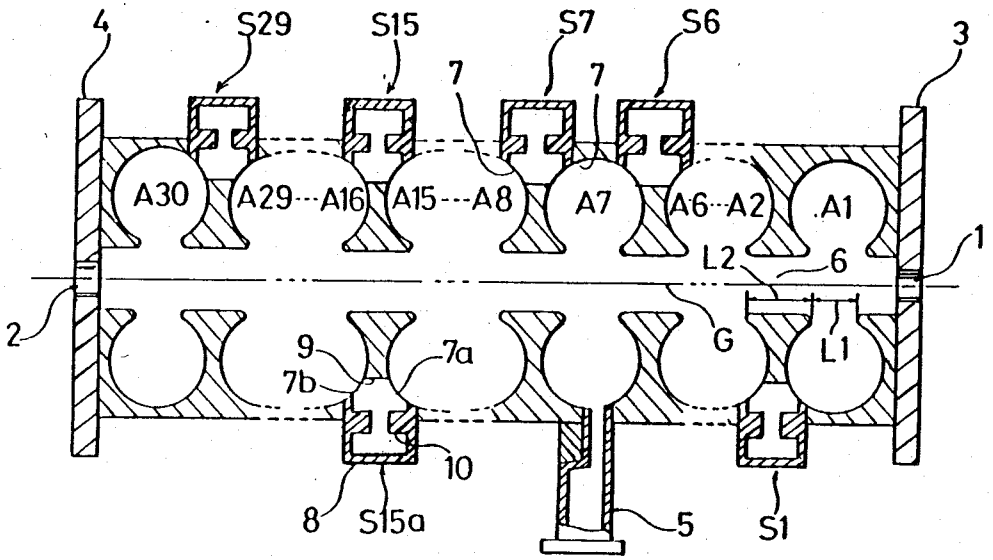
FIG. 1 is a cross-sectional view showing a typical example of a side-coupled standing-wave accelerator.
Figure 2:
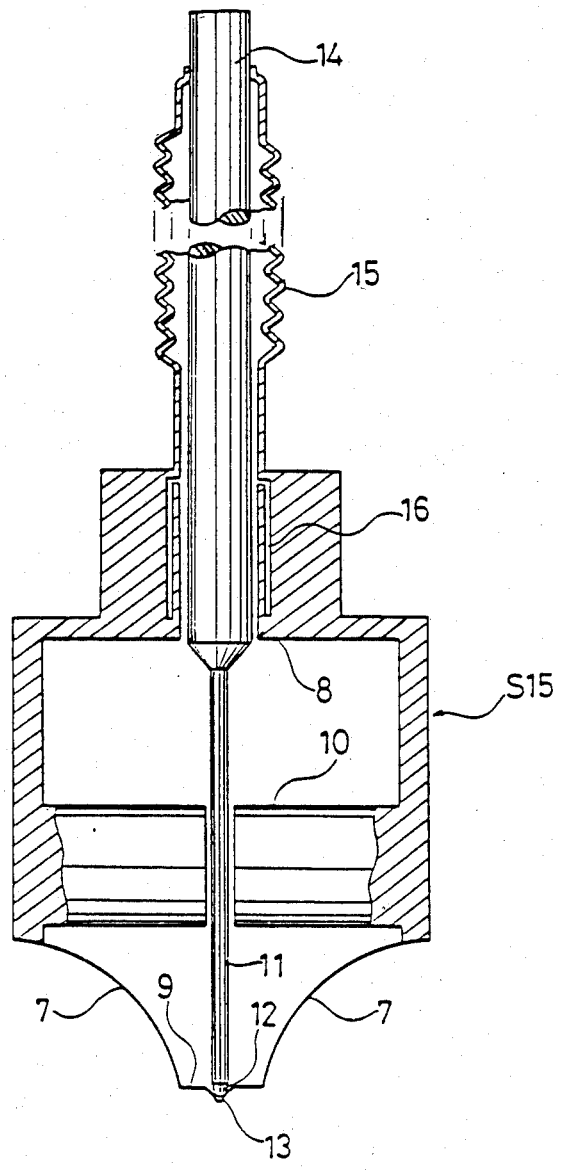
FIG. 2 is a cross-sectional view showing a detuning structure in a first embodiment of the present invention.

A first embodiment of the present invention is constituted by adding the detuning structure shown in FIG. 2 to the coupling cavity S15*a* of the accelerator shown in FIG. 1. The coupling cavity S15*a* in FIG. 1 is provided at the same position in view of cavity number as the coupling cavity S15, and this cavity S15*a* has different sized coupling openings *7a, 7b* having different coupling coefficients.

Referring to FIG. 2, wherein like reference numerals designate like elements and components to those in FIG. 1, the reference numeral 11 designates a detuning rod having a touch end 12. The opposing circular side wall 9 is provided with a recess 13 adapted to receive the touch end 12. The detuning rod 11 is supported by a support 14, around which a bellows member 15 is provided so as to maintain a vacuum. The reference numeral 16 designates a choking member.

Although FIG. 2 shows the same sized coupling openings 7, the detuning structure can be easily modified to be used in the coupling cavity S15*a* having the different sized coupling openings *7a* and *7b*.

Figure 3:
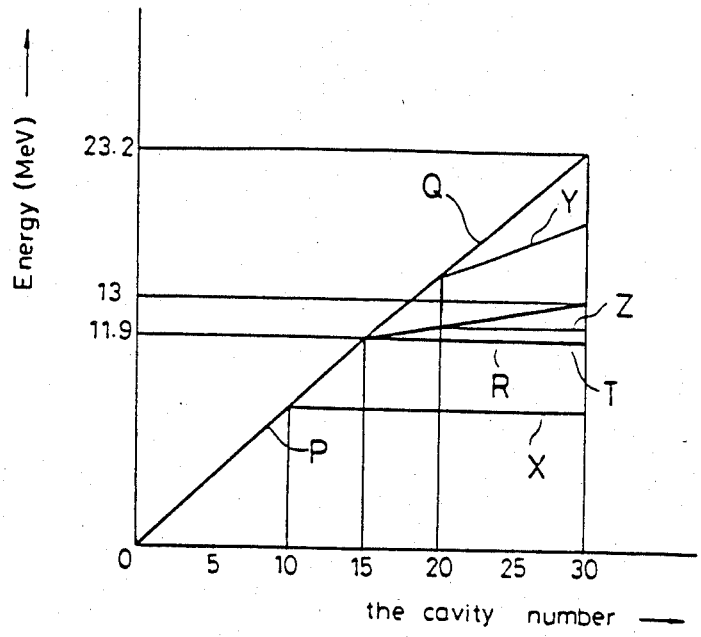
FIG. 3 is a graph showing the energy gains obtained in the present invention.

Referring to FIG. 3, the operation will be described:

The x-axis represents the number of the accelerating cavities, and the y-axis represents the energy V. The P represents energy gains obtained by the accelerating cavities A1 to A15 located preceding to the coupling cavity S15. The Q represents energy gains obtained through the acceleration carried out by all the accelerating cavities A1 to A30 when the coupling cavity S15*a* is detuned. The R represents energy gains obtained when the coupling cavity S15 is detuned. The T represents energy gains when the both coupling cavities S15 and S15*a* are detuned.

The length from the accelerating cavity A1 up to A15 is about 0.79 m, and the beam energy obtained will be 15 MeV×0.79 m=11.9 MeV. The required microwave electric power Po will be 2.6 MW. When the coupling cavity S15*a* which is provided at the cavity number 15 is detuned, the energy gains P and Q are obtained, wherein the energy of the end of the P is 11.9 MeV. And when the coupling cavity S15 is detuned, the microwave is attenuated in transmitting to the No. 16 accelerating cavity A16 through the coupling cavity S15*a*, and the energy gains P and R are obtained, the final energy becoming 13 MeV. The inclination of the R can be varied by varying the coupling coefficients of the two coupling openings *7a* and *7b*. When the both cavities S15 and S15*a* are detuned the energy gains P and T are obtained, the final energy becoming about 11.2 MeV by the leakage of electric power of about −20 dB.

The input power of the microwave when the coupling cavity S15 is detuned is selected so as to obtain the same intensity of electric field in accelerating cavities A1 to A15 as the one obtained in acceleration by all the cavities A1 to A30 which is realized by detuning the coupling cavity S15*a*.

The detuning structure used in the present invention includes the detuning rod 11, which is spacedly passed through the gap between the projecting posts 10, and keeps contact with the opposing circular side wall 9 of the cylindrical coupling cavity S15.

There is a conventional system for detuning the reentrant type cavity where it is arranged such that the detuning rod 11 is inserted through the circular side wall 8 and the length of insertion is adjusted in accordance with the degree of attenuation to be obtained, but does not reach the projecting posts 10 or at least the opposing side wall 9. However, the conventional system is not applicable to the present invention because of the insufficient detuning effect. The only effect is to attenuate the electric power transmitting to the subsequent accelerating cavities by about −10 dB.

In contrast, under the present invention the detuning rod 11 is spacedly passed through the gap between the projecting posts 10, and is extended until it not only keeps contact with the opposing circular side wall 9 but also resets in the recess 13. In addition, the touch end 12 is made of metal of a different kind from the metal (usually copper) of the opposing circular side wall 9. For example, when the side wall 9 is made of copper, the touch end 12 is made of steel. The fact that the recess 13 is provided and that the touch end 12 is made of a different kind of metal is effective to prevent the discharge of the microwave, and even if it occurs, the degree thereof is limited, thereby causing no melting trouble. Besides, a space must be made between the detuning rod 11 and the posts 10. Either a metal (e.g. copper) plate or a flat bar can be used for the detuning rod 11.

Under the detuning structure described above the leakage of electric power to the accelerating cavities subsequent to the detuned coupling cavity, if any, is minimized to the extent of about −20 dB. The switching of the energy gain, that is, the detuning or nondetuning is carried out by inserting the detuning rod 11 to reach the recess 13 or withdrawing the same up to the inside of the circular side wall 8.

Figure 4:
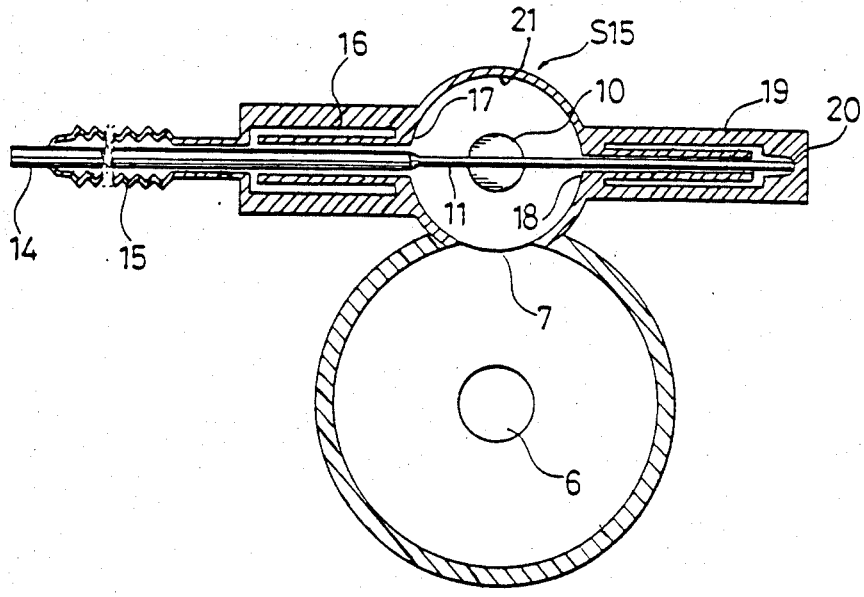
FIG. 4 is a cross-sectional side view showing a second embodiment of the present invention.

In the embodiment described above the detuning rod 11 is vertically inserted against the mutually opposing side walls 8 and 9 of the cylindrical coupling cavity, and therefore, it was difficult for the detuning rod 11 to have a choking structure at the touch end 12. To solve this difficulty, the detuning rod 11 can be inserted in a direction vertical to that of insertion of the detuning rod 11 in the device of FIG. 2, as shown in FIG. 4. In FIG. 4, the detuning rod 11 is inserted through two mutually opposing portions 17 and 18 of the cylindrical internal wall 21 of the coupling cavity S15. This structure allows the detuning rod 11 to have a choking structure 19 without difficulty, thereby ensuring the preventive effect against a possible discharge. Reliability is also enhanced. The reference numeral 20 designates a recess in which the detuning rod 11 is secured.

In the illustrated embodiments thirty accelerating cavities and twenty-nine coupling cavities are used, but the numbers are not limited thereto. It is of course possible to detune any coupling cavity selected from those located subsequent to the waveguide 5. When three or more kinds of energy gains are to be selected, it is possible by increasing the number of coupling cavities with a detuning structure.

For example, if the coupling cavity S10 is provided with a detuning structure, the energy gains P and X shown in FIG. 3 are obtained when the cavity S10 is detuned. If the coupling cavity S20 is provided with a detuning structure and a coupling cavity S20*a* which has different sized coupling openings is provided at the cavity number 20, the energy gains P and Y are obtained when the cavity S20 is detuned. If the coupling cavity S20 is provided with a detuning structure in the device of the first embodiment the energy gains P, the initial portion of R, and Z are obtained when the cavity S15*a* and the cavity S20 are detuned.

As described above, the standing-wave accelerator of the invention includes a detuning rod provided to be inserted from the first wall of the coupling cavity until it comes into contact with the second wall thereof, wherein the detuning rod is spacedly passed between the inwardly projecting posts. This structure cuts off the transmission of the microwave to subsequent accelerating cavities, thereby enabling to obtain variable energy gains of desired value. Accordingly, the reliability of the standing-wave accelerator is enhanced.

What is claimed is:

1. A standing-wave accelerator which comprises:

a plurality of accelerating cavities arranged along an axial direction of the accelerator;

a plurality of cylindrical coupling cavities, one of said plurality of coupling cavities being provided between adjacent ones of said plurality of accelerating cavities, each of said plurality of coupling apparatus having a first wall and a second wall;

one of said plurality of coupling cavities having a pair of inwardly projecting posts connected to a third wall and a fourth wall respectively of said one of said plurality of coupling cavities; and detuning means inserted from said first wall of said one coupling cavity to extend until it comes into contact with said second wall thereof, spacedly passed between said pair of inwardly projecting posts for detuning said one of said plurality of coupling cavities.

2. A standing-wave accelerator as set forth in claim 1, wherein said second wall comprises a recess adapted to receive a terminating end of said detuning means.

3. A standing-wave accelerator as set forth in claim 1, wherein said terminating end of said detuning means is made of a first metal and said second wall is made of a second metal, said first and second metals being of different types.

4. A standing-wave accelerator as set forth in claim 1, wherein said first and said second wall are two mutually opposing circular side walls of the cylindrical coupling cavity.

5. A standing-wave accelerator as set forth in claim 1, wherein the first and the second wall are two mutually opposing portions of the cylindrical internal wall of the cylindrical coupling cavity.

6. A standing-wave accelerator which comprises:

a plurality of accelerating cavities arranged along the axis direction of the accelerator;

a plurality of coupling cavities provided between the two adjacent accelerating cavities;

one of the coupling cavities being provided with a detuning means for detuning the coupling cavity;

an additional coupling cavity being provided at a position opposite from said one of the coupling devices, adjacent to the same two accelerating cavities at said one of the coupling devices, the additional coupling cavity having coupling openings different in size from coupling openings of said one of the coupling cavities; and the detuning means provided to be inserted from a first wall of the coupling cavity to extend until it comes into contact with a second wall thereof, spacedly passed between a pair of inwardly projecting posts connected to a third and fourth wall of said one of the coupling cavities.

* * * * *